US007834889B2

(12) United States Patent
Mizoguchi

(10) Patent No.: US 7,834,889 B2
(45) Date of Patent: Nov. 16, 2010

(54) DATA CONVERSION CIRCUIT HAVING LOOK-UP TABLE AND INTERPOLATION CIRCUIT AND METHOD OF DATA CONVERSION

(75) Inventor: Yuji Mizoguchi, Mihama-ku (JP)

(73) Assignee: Kawasaki Microelectronics, Inc., Chiba (JP)

( * ) Notice: Subject to any disclaimer, the term of this patent is extended or adjusted under 35 U.S.C. 154(b) by 1457 days.

(21) Appl. No.: 11/207,870

(22) Filed: Aug. 22, 2005

(65) Prior Publication Data

US 2006/0044618 A1 Mar. 2, 2006

(30) Foreign Application Priority Data

Aug. 24, 2004 (JP) ..... 2004-243481

(51) Int. Cl.
*G09G 5/00* (2006.01)

(52) U.S. Cl. ..... 345/606; 345/616

(58) Field of Classification Search ..... 345/600
See application file for complete search history.

(56) References Cited

U.S. PATENT DOCUMENTS 6,853,384 B2 2/2005 Miyata et al.
2002/0050965 A1 5/2002 Oda et al.
2003/0179175 A1* 9/2003 Shigeta et al. ..... 345/101
2003/0210217 A1 11/2003 Lee
2004/0070590 A1* 4/2004 Lee et al. ..... 345/690
2005/0062702 A1 3/2005 Lee et al.

FOREIGN PATENT DOCUMENTS

JP 10-39837 2/1998

* cited by examiner

*Primary Examiner*—Xiao M Wu
*Assistant Examiner*—Maurice McDowell, Jr.
(74) *Attorney, Agent, or Firm*—Oliff & Berridge, PLC

(57) ABSTRACT

Data conversion circuits and methods of data conversion that enable to keep the continuity in the converted data while reducing a required memory capacity are disclosed. An exemplary conversion circuit includes a LUT that stores representative correction values and an interpolation circuit that generates conversion data by interpolating from representative correction values stored in cells of the LUT that surround an address corresponding to the combination of input signal levels. When the cells that surround the address include a pair of adjacent cells arranged along both sides of a diagonal line of the LUT, the interpolation circuit substitutes one of the representative correction values with a substituted representative correction value that indicates an opposite direction and a same amount of correction as indicated by the other one of the representative correction values stored in the adjacent cells, and then generates the conversion data.

20 Claims, 7 Drawing Sheets

FIG. 8

26 diagonal line

| | | | | | | | | | | | | | | | |
|---|---|---|---|---|---|---|---|---|---|---|---|---|---|---|---|
| 32 | 52 | 50 | 44 | 46 | 40 | 37 | 36 | 34 | 32 | | | | | | |
| 28 | 42 | 40 | 38 | 38 | 36 | 33 | 30 | 28 | 23 | | | | | | |
| 24 | 34 | 32 | 32 | 32 | 29 | 27 | 24 | 19 | 19 | | | | | | |
| 20 | 28 | 26 | 26 | 28 | 24 | 20 | 12 | 15 | 12 | | | | | | |
| 16 | 23 | 21 | 20 | 20 | 16 | 10 | 6 | 8 | 6 | | | | | | |
| 12 | 16 | 15 | 14 | 12 | 8 | 6 | 2 | 2 | 0 | | | | | | |
| 8 | 10 | 10 | 8 | 3 | 2 | 0 | −4 | −4 | −4 | | | | | | |
| 4 | 5 | 4 | 0 | −3 | −4 | −6 | −14 | −8 | −10 | | | | | | |
| 0 | 0 | −2 | −6 | −10 | −10 | −12 | −20 | −14 | −20 | | | | | | |
| | 0 | 4 | 8 | 12 | 16 | 20 | 24 | 28 | 32 | | | | | | |

Current−frame signal level a0

Previous−frame signal level b0

DATA CONVERSION CIRCUIT HAVING LOOK-UP TABLE AND INTERPOLATION CIRCUIT AND METHOD OF DATA CONVERSION

This invention was first described in Japanese Patent Application No. 2004-243481, which is hereby incorporated by reference in its entirety.

BACKGROUND

This invention relates to data conversion circuits that generate conversion data by an interpolation from output values output from a look-up table (LUT) that only stores data corresponding to combinations of representative levels of a set of input data. This invention also relates to methods of data conversion utilizing the interpolation.

In a data conversion circuit that utilizes a LUT, output data corresponding to combinations of a set of input data is stored in each address of the LUT. By supplying an address corresponding to the set of input data, the LUT outputs the output data stored in that address. Thus, the set of input data is converted to the output data corresponding to the set of input data.

In the data conversion circuit, not all of the output data corresponding to all the combinations of the set of input data are stored in the LUT. That is, in order to reduce required memory capacity, only the output data corresponding to combinations of representative levels, e.g., every one of fourth levels, of the set of input data is stored. Interpolations from the output data corresponding to combinations of the representative levels near the levels of the input data generates the output data corresponding to the combinations that are not stored in the LUT.

As an example of data conversion circuit utilizing a LUT, a liquid crystal display (LCD) apparatus according to Japanese laid-open patent No. 10-39837 (Reference 1) will be described.

In the LCD display apparatus disclosed in Reference 1, in order to improve the response of a liquid crystal display panel, a pixel-driving signal to be supplied to a LCD panel is converted using a LUT such that the level (tone) of the signal is over-driven.

In order to display a video image on a LCD panel, image data, which includes signals for driving pixels that makes up a frame, is successively supplied with a fixed interval. When the level of pixel-driving signal changes from a starting level in the previous frame to a target level in the current frame, the brightness of the pixel does not reach the value corresponding to the target level during the current frame, because the orientation of liquid crystal molecules cannot change rapidly. As a result, especially when displaying a moving image, the quality of the displayed image is low.

In order to improve the quality of the image, over-drive technique is employed. It will be assumed that the pixel-driving signal of a liquid crystal display panel has a resolution of 8 bits, or 256 signal levels, and that the level of pixel-driving signal changes from 10 in the previous frame to 100 in the current frame. In this case, for example, a converted, or a corrected pixel-driving signal with a signal level of 150, instead of 100, is supplied. Accordingly, the response of the liquid crystal display panel and the quality of the image displayed on the panel are improved.

In order to generate correction data, a LUT that stores correction values corresponding to various combinations of signal levels of the current-frame and the previous-frame pixel-driving signals is provided. The first data including the level of current-frame pixel-driving signal and the second data including the level of previous-frame pixel-driving signal are input to the LUT. The LUT then outputs the correction value or values corresponding to the specific combination of the signal levels. Specifically, the LUT stores the correction values in 2-dimensionally arranged cells, and the combination of the signal levels of the input data is used as the address to access the LUT so that the LUT outputs the correction value stored in the cell corresponding to the address.

When the level of the signal to drive a pixel in the current frame is the same as the level of the signal to drive the same pixel in the previous frame, no conversion, or correction, of the pixel-driving signal is required. When both levels of the previous-frame and of the current-frame signals are 100, for example, an uncorrected signal with the level of 100 should be supplied to the pixel. Thus, correction values indicating that no correction is made are stored in the cells arranged on the diagonal line (diagonal cells), which correspond to the situation where the levels of the current-frame and the previous-frame data are the same. For example, zeros are stored as the correction values in the diagonal cells.

On the other hand, correction values indicating positive corrections (i.e., increases of the signal levels) are stored in the cells arranged in the area on one side of the diagonal line. In the example explained above, when the level of pixel-driving signal increases from 10 in the previous-frame to 100 in the current-frame, the signal level is corrected to 150. That is, a positive correction with an amount of 50 levels is made. To realize this result, for example, a correction value of 50 is stored in the cell corresponding to the address (10, 100).

Furthermore, correction values indicating negative corrections (i.e., decreases of the signal levels) are stored in the cells arranged in the area on the other side of the diagonal line. Due to the non-linear response of the liquid crystal display panel, however, the amount of the negative correction is not necessarily the same as the amount of the positive correction, even when the input signal level changes toward the opposite direction with the same levels.

For example, when the signal level decreases from 100 in the previous-frame to 10 in the current-frame, the amount of negative correction is not necessarily equal to 50. Thus, the correction value stored in the cell corresponding to the address (100, 10) is not necessarily −50. In other words, the correction value stored in the cell corresponding to the address (100, 10) does not necessarily have the same absolute value as the correction value stored in the cell corresponding to the address (10, 100). Or, more generally, the amount of corrections indicated by the pair of correction values stored in a pair of cells arranged symmetrically on both sides of the diagonal line are not necessarily the same.

When the LUT only stores representative correction values corresponding to combinations of representative levels, the LUT outputs representative correction values stored in the cells surrounding the address corresponding to the combination of the signal levels. The correction value for the combination of the signal levels is then generated by an interpolation from the representative correction values. Even in this case, when the current-frame signal level and the previous-frame signal level are the same, or when the difference between the signal levels is small, the amount of correction should be small in order to maintain the continuity of the corrected signal.

In reality, however, when at least one of the signal levels of the set of input data is not equal to any of the representative levels and the difference between the signal levels is small, the surrounding cells includes one of the pairs of cells arranged symmetrically along both sides of the diagonal line.

Accordingly, the correction value is generated by the interpolation using the representative correction values stored in the pair of cells arranged along both sides of the diagonal line.

As noted above, however, the representative correction values stored in the pair of cells arranged symmetrically on both sides of the diagonal line may indicate corrections toward opposite directions with different amounts. Thus, the correction value generated by the interpolation may be inadequate. That is, the generated correction value may indicate a relatively large amount of correction, even when the difference between the previous-frame and the current-frame signal levels is small. As a result, the converted data may lose continuity and the display quality may degrade.

SUMMARY

An exemplary objective of this invention is to provide data conversion circuits and methods of data conversion that enable to keep the continuity in the converted data while reducing the memory capacity required for providing the LUT.

In order to solve the above-mentioned problems, various exemplary embodiments according to this invention provide a data conversion circuit for generating conversion data from a set of input data. Each set of input data includes a signal level selected from a plurality of allowable levels including representative levels. The exemplary conversion circuit includes a look-up table (LUT) that stores output data including representative correction values corresponding to combinations of the representative levels of the set of input data in two- or three-dimensionally arranged cells. The cells include diagonal cells arranged on a diagonal line of the LUT and a plurality of pairs of adjacent cells. Each of the pairs of adjacent cells is arranged symmetrically along both sides of the diagonal line. The exemplary data conversion circuit further includes an interpolation circuit that generates the conversion data by interpolating from the representative correction values stored in the cells of the LUT that surround an address corresponding to a combination of the signal levels of the set of input data. The representative correction values stored in the diagonal cells indicate that no conversion is made, and the representative correction values stored in at least one of the pairs of adjacent cells have mutually opposite signs and different absolute values. Moreover, the interpolation circuit substitutes, when the cells that surround the address include the at least one of the pairs of adjacent cells, one of the representative correction values stored in the adjacent cells with a substituted representative correction value having a sign opposite to and an absolute value same as those of the other one of the representative correction values stored in the adjacent cells, and then generates the conversion data using the substituted representative correction value.

According to various exemplary embodiments, the data conversion circuit may further include an address detection circuit that detects whether the address is within a range from the diagonal line of the LUT such that the cells that surround the address include one of the pairs of adjacent cells, and the interpolation circuit may substitute the one of the representative correction values when the address detection circuit detects that the address is within the range. According to various other exemplary embodiments, the data conversion circuit may further include an address conversion circuit that generates the address from the signal levels of the set of input data.

According to various other exemplary embodiments, the LUT may be a two-dimensional LUT, and the interpolation circuit may generate the conversion data by a linear interpolation from, for example, four of the representative correction values corresponding to combinations of two of the representative levels adjacent to the signal level of each of the set of input data.

In order to solve the above-mentioned problems, various exemplary embodiments according to this invention provide a data conversion circuit for generating conversion data from a set of input data. The exemplary conversion circuit includes a look-up table (LUT) that stores output data including representative correction values that indicate directions and amounts of corrections corresponding to combinations of the representative levels of the set of input data in two- or three-dimensionally arranged cells. The cells include diagonal cells arranged on a diagonal line of the LUT and a plurality of pairs of adjacent cells. Each of the pairs of adjacent cells is arranged symmetrically along both sides of the diagonal line. The exemplary data conversion circuit further includes an interpolation circuit that generates the conversion data by interpolating from the representative correction values stored in the cells of the LUT that surround an address corresponding to a combination of the signal levels of the set of input data. The representative correction values stored in the diagonal cells indicate that no correction is made, and the representative correction values stored in at least one of the pairs of adjacent cells indicate mutually opposite directions and different amounts of the corrections. Moreover, the interpolation circuit substitutes, when the cells that surround the address include the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and then generates the conversion data using the substituted representative correction value.

According to various exemplary embodiments, the representative correction values stored in the diagonal cells may be zero, and the substituted representative correction value and the other one of the representative correction values stored in the adjacent cells may have mutually opposite signs and a same absolute value. According to various other exemplary embodiments, the representative correction values stored in the diagonal cells may be equal to respective corresponding ones of the representative levels of one of the set of input data, and a first difference between the substituted representative correction value and a first corresponding one of the representative levels of the one of the set of input data and a second difference between the other one of the representative correction values stored in the adjacent cells and a second corresponding one of the representative levels of the one of the set of input data may have mutually opposite signs and a same absolute value.

In order to solve the above-mentioned problems, various exemplary embodiments according to this invention provide a data conversion circuit that includes an input terminal for receiving current input data. The input data having a signal level selected from a plurality of allowable levels including representative levels. The exemplary data conversion circuit further includes a memory for storing the current input data and for outputting a previous input data, and a look-up table (LUT) that stores representative correction values that indicate directions and amounts of corrections corresponding to combinations of the representative levels of the current and previous input data in two-dimensionally arranged cells. The cells include diagonal cells arranged on a diagonal line of the LUT and a plurality of pairs of adjacent cells. Each of the pairs of adjacent cells is arranged symmetrically along both sides of the diagonal line. The exemplary data conversion circuit still further includes an interpolation circuit that generates a correction value corresponding to a combination of the signal levels of the current and the previous input data by interpolating from the representative correction values stored in the cells of the LUT that surround an address corresponding to the combination of the signal levels. The representative correction values stored in the diagonal cells indicate that no correction is made, and the representative correction values stored in at least one of the pairs of adjacent cells indicate mutually opposite directions and different amounts of the corrections. Moreover, the interpolation circuit substitutes, when the cells that surround the address includes the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and then generates the correction value using the substituted representative correction value.

In order to solve the above-mentioned problems, various exemplary embodiments according to this invention provide a method of data conversion that includes receiving a set of input data. Each set of input data includes a signal level selected from a plurality of allowable levels including representative levels. The exemplary method further includes providing a look-up table (LUT) that stores output data including representative correction values corresponding to combinations of the representative levels of the set of input data in two- or three-dimensionally arranged cells. The cells include diagonal cells arranged on a diagonal line of the LUT and a plurality of pairs of adjacent cells. Each of the pairs of adjacent cells is arranged symmetrically along both sides of the diagonal line. The exemplary method further includes generating a conversion data by interpolating from the representative correction values stored in the cells of the LUT that surround an address corresponding to a combination of the input levels of the set of input data. The representative correction values stored in the diagonal cells indicate that no conversion is made, and the representative correction values stored in at least one of the pairs of adjacent cells have mutually opposite signs and different absolute values. Moreover, generating the conversion data includes substituting, when the cells that surround the address include the at least one of the pairs of adjacent cells, one of the representative correction values stored in the adjacent cells with a substituted representative correction value having a sign opposite to and an absolute value same as those of the other one of the representative correction values stored in the adjacent cells, and the interpolation is performed using the substituted representative correction value.

In order to solve the above-mentioned problems, various exemplary embodiments according to this invention provide a method of data conversion that includes receiving a set of input data. Each set of input data includes a signal level selected from a plurality of allowable levels including representative levels. The exemplary method further includes providing a look-up table (LUT) that stores output data including representative correction values that indicate directions and amounts of corrections corresponding to combinations of the representative levels of the set of input data in two- or three-dimensionally arranged cells. The cells include diagonal cells arranged on a diagonal line of the LUT and a plurality of pairs of adjacent cells. Each of the pairs of adjacent cells is arranged symmetrically along both sides of the diagonal line. The exemplary method further includes generating a conversion data by interpolating from the representative correction values stored in the cells of the LUT that surround an address corresponding to a combination of the signal levels of the set of input data. The representative correction values stored in the diagonal cells indicate that no conversion is made, and the representative correction values stored in at least one of the pairs of adjacent cells indicate mutually opposite directions and different amounts of the corrections. Moreover, generating the conversion data includes substituting, when the cells that surround the address include the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and the interpolation is performed using the substituted representative correction value.

In order to solve the above-mentioned problems, various exemplary embodiments according to this invention provide a method of data conversion that includes receiving a current input data having a signal level selected from a plurality of allowable levels including representative levels, storing the current input data into a memory and outputting a previous input data from the memory. The exemplary method further includes providing a look-up table (LUT) that stores representative correction values that indicate directions and amounts of corrections corresponding to combinations of the representative levels of the current and previous input data in two-dimensionally arranged cells. The cells include diagonal cells arranged on a diagonal line of the LUT and a plurality of pairs of adjacent cells. Each of the pairs of adjacent cells is arranged symmetrically along both sides of the diagonal line. The exemplary method further includes generating a correction value corresponding to a combination of the signal levels of the current and previous input data by interpolating from the representative correction values stored in the cells of the LUT that surround an address corresponding to the combination of the signal levels of the current and the previous input data. The representative correction values stored in the diagonal cells indicate that no conversion is made, and the representative correction values stored in at least one of the pairs of adjacent cells indicate mutually opposite directions and different amounts of the corrections. Moreover, generating the correction value includes substituting, when the cells that surround the address include the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and the interpolation is performed using the substituted representative correction value.

BRIEF DESCRIPTION OF THE DRAWINGS

FIG. 8 shows another exemplary LUT to be used in exemplary data conversion circuits according to this invention.

DETAILED DESCRIPTION OF EMBODIMENTS

Data conversion circuits according to various exemplary embodiments of this invention will be explained with reference to attached drawings.

Figure 1:
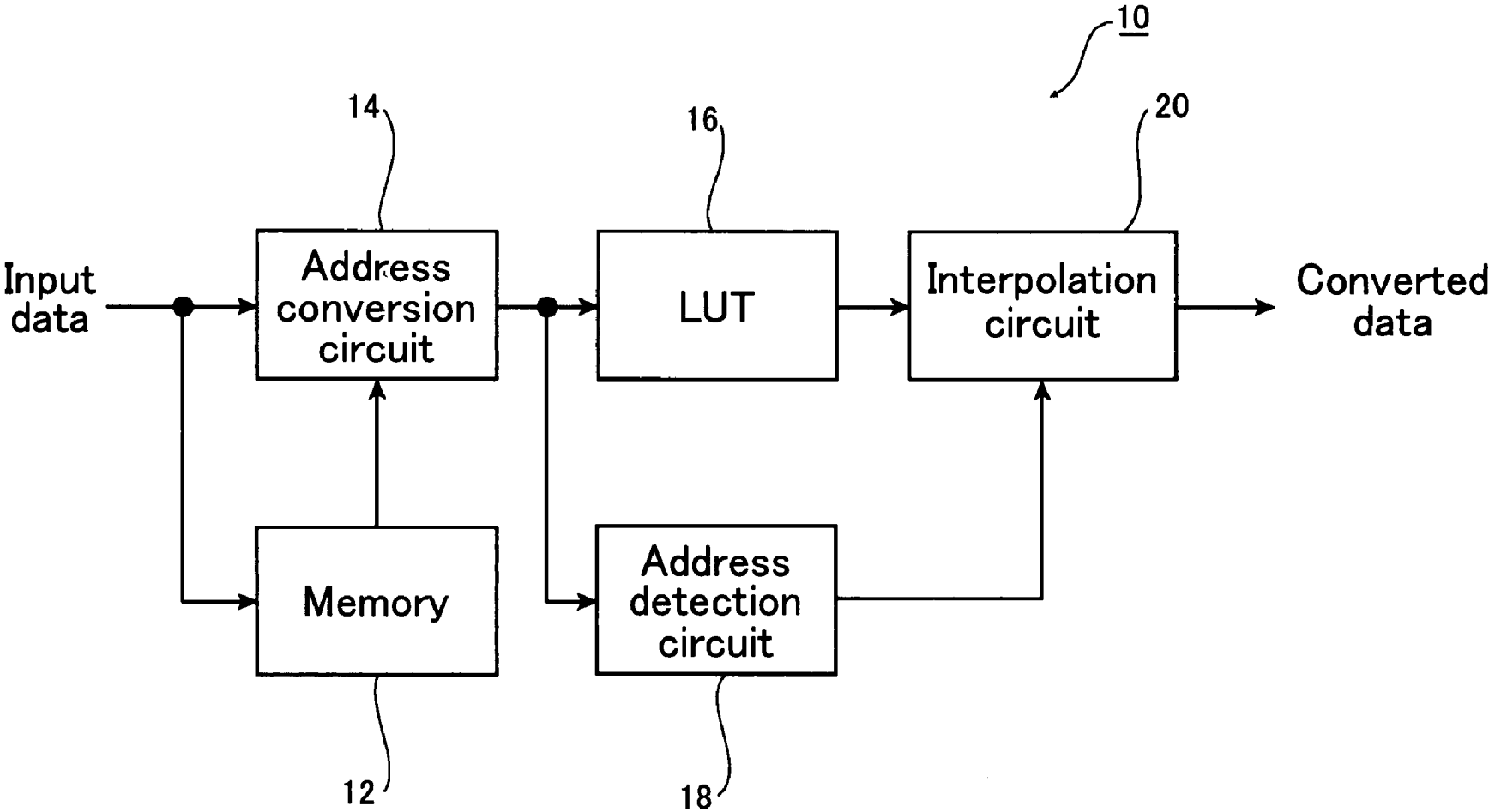
FIG. 1 is a schematic drawing of an exemplary data conversion circuit according to this invention.

FIG. 1 is a schematic drawing of an exemplary data conversion circuit according to an embodiment of this invention. The data conversion circuit 10 shown in FIG. 1 is used as part of a liquid crystal display apparatus. The data conversion circuit 10 generates correction values that correct the levels of the pixel-driving signal for driving the liquid crystal display panel from the current-frame and previous-frame signal levels of the pixel-driving signal. The conversion circuit 10 also outputs the generated correction values as the conversion data.

The exemplary correction circuit 10 includes a memory 12, an address conversion circuit 14, a LUT 16, an address detection circuit 18, and an interpolation circuit 20.

The data conversion circuit 10 receives current-frame pixel-driving signal as input data and supplies the received signal to the memory 12 and the address conversion circuit 14. For example, R, G, B signals, each having a resolution of 8 bits (256 levels), are input for each pixel. In other words, each of the signals may take one of the 256 allowable levels. In the following description, for simplicity, it is assumed that signals having 8 bits resolutions are input for each pixel.

The memory 12 is a frame memory. The memory 12 stores the current-frame signal levels and outputs the previous-frame signal levels that have been previously stored. Thus, as shown in FIG. 1, the address conversion circuit 14 receives two input data, i.e., a first input data including the current-frame signal level and a second input data including the previous-frame signal level.

The address conversion circuit 14 generates an address from the two input data and supplies the generated address to the LUT 16 and the address detection circuit 18. For example, two 8-bit data each representing the current-frame or the previous-frame signal level are joined to generate a 16-bit address.

The LUT 16 is a 2-dimensional LUT. That is, LUT 16 stores, as the output data, correction values corresponding to two input data including the current-frame signal level and the previous-frame signal level.

Figure 2:
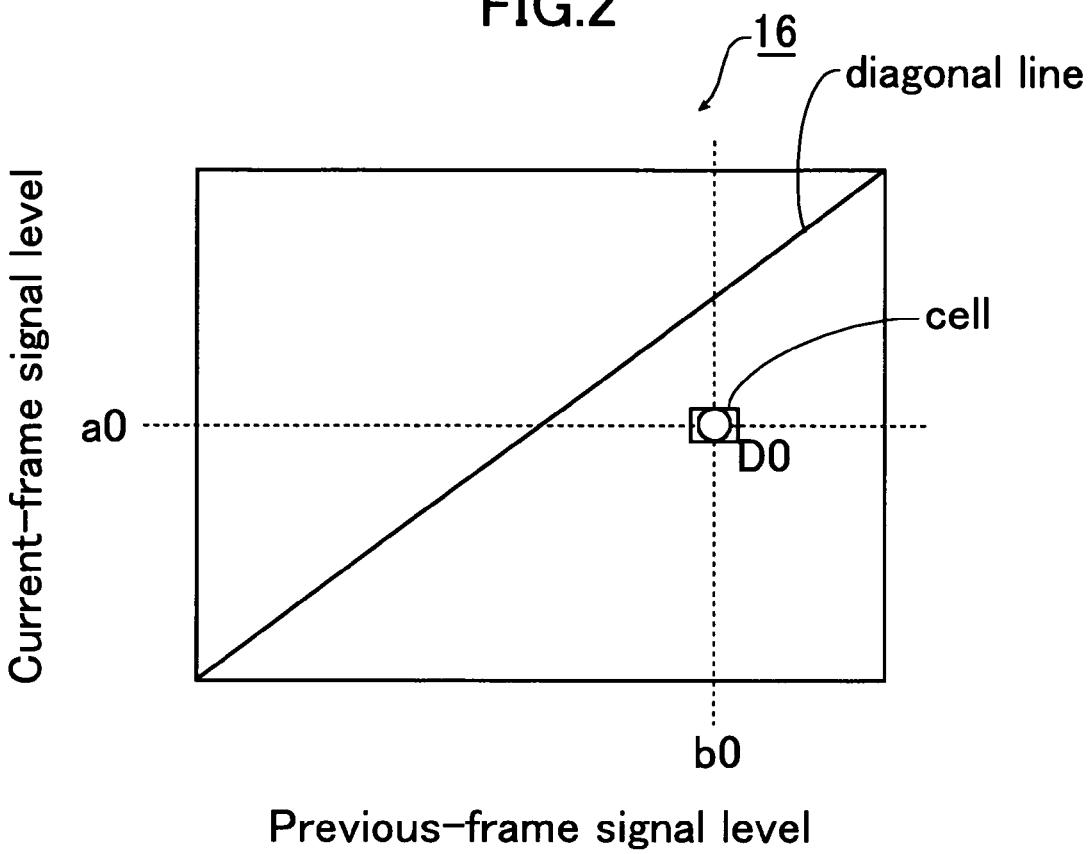
FIG. 2 shows an exemplary structure of a LUT.

FIG. 2 shows an exemplary structure of a LUT 16. The LUT 16 stores correction values D0 corresponding to combinations of the signal levels of the set of input data (i.e., levels of the current-frame signal a0 and the previous-frame signal b0). Specifically, in the exemplary LUT 16, only representative correction values corresponding to combinations of representative levels of the input data are stored.

In this specification, each of the places of the LUT 16 for storing the correction value D0 is called a "cell". The cells are arranged two-dimensionally in the LUT 16 in relation to the levels of the input data a0 and b0. Accordingly, each of the correction values D0 stored in the cells is accessible using the combination of the levels of the input data a0 and b0 as an address.

In practice, the LUT 16 may be constructed using a memory block such as a static random-access memory (SRAM) block. The physical structure of the LUT 16 constructed in the SRAM block may be different from that shown in FIG. 2. Nonetheless, the correction values D0 are stored in the SRAM block in relation to the levels of two input data a0 and b0. Accordingly, the LUT 16 constructed in the SRAM block has the two-dimensional logical structure as schematically shown in FIG. 2.

When the LUT 16 is constructed in a SRAM block, each of the correction values D0 may be stored in a word of the SRAM block, which is accessible using an address within the SRAM block. Note that, the address of the word in the SRAM block is not necessarily the same as the address of the cell in the LUT 16. Nonetheless, these addresses are interrelated so that the correction value D0 stored in the word of the SRAM block is accessible using the combination of the levels of the input data a0 and b0.

The correction value D0 stored in the LUT 16 may be a value to be added to the current-frame signal level to generate the corrected, or the converted signal level. Alternatively, the LUT may store the corrected, or the converted signal level, as the correction value D0.

The output data stored in the cells arranged on the diagonal line of the LUT 16, which correspond to combinations of mutually equivalent representative levels of the set of input data (a0=b0), indicate that no data conversion is made. Furthermore, at least some of the pairs of the output data stored in pairs of cells positioned symmetrically along both sides of the diagonal line (adjacent cells) indicate corrections toward opposite directions with different amounts.

For example, when the LUT 16 stores representative correction values that are to be added to the current-frame signal levels, each of the representative correction values stored in the cells arranged on the diagonal line is zero. Furthermore, at least one of the pairs of representative correction values stored in the pairs of adjacent cells have mutually opposite signs and different absolute values.

When the address supplied from the address conversion circuit 14 corresponds to one of the combinations of the representative levels of the input data, the LUT 16 outputs the output data (representative correction value) stored in the cell corresponding to the address. Otherwise, the LUT 16 outputs a plurality of output data corresponding to combinations of representative levels adjacent to the signal levels of the two input data. In other words, the LUT 16 output the representative correction values stored in the cells surrounding the address corresponding to the combination of the levels of the input data a0 and b0. For example, the LUT 16 outputs representative correction values stored in four of the cells corresponding to combinations of two representative levels on both sides of the input signal level for each of the input data.

The output data output from the LUT 16 is input to the interpolation circuit 20.

The address detection circuit 18 detects whether the address output from the address conversion circuit 14 locates on or near the diagonal line of the LUT 16. The detection signal output from the address detection circuit 18 is input to the interpolation circuit 20.

The detection by the address detection circuit 18 is made by, for example, comparing two portions of the address supplied from the address conversion circuit 14 each corresponding to the signal level of the input data and to the level of the signal output from the memory 12. The range within which the address is detected as near the diagonal line of the LUT 16 is determined appropriately. For example, when the address is within a range that the surrounding cells include one of the pairs of adjacent cells, the address may be determined to be near the diagonal line.

The interpolation circuit 20 generates the correction value for correcting the level of pixel-driving signal to be supplied to the liquid crystal panel. The correction value is generated by an interpolation using the output data (representative correction values) supplied from the LUT 16 and the detection signal output from the address detection circuit 18.

When the address corresponds to one of the combinations of the representative levels of the input data, the interpolation circuit 20 does not perform the interpolation. That is, the interpolation circuit merely outputs the output data supplied from the LUT 16, which is the representative correction value stored in the corresponding cell of the LUT 16, as the correction value. The correction value is used for correcting the level of pixel-driving signal to be supplied to the liquid crystal panel.

The address detection circuit 18 may also detect whether the address corresponds to one of the combinations of representative levels of the input data and output a detection signal indicating the result of the detection. Then, the interpolation circuit 20 may alter its operation depending on the detection signal supplied from the address detection circuit 18.

When the detection signal indicates that the address does not correspond to any of the combinations of the representative levels and that the address is not on or near the diagonal line, the interpolation circuit 20 generates the correction value via an interpolation.

Figure 3:
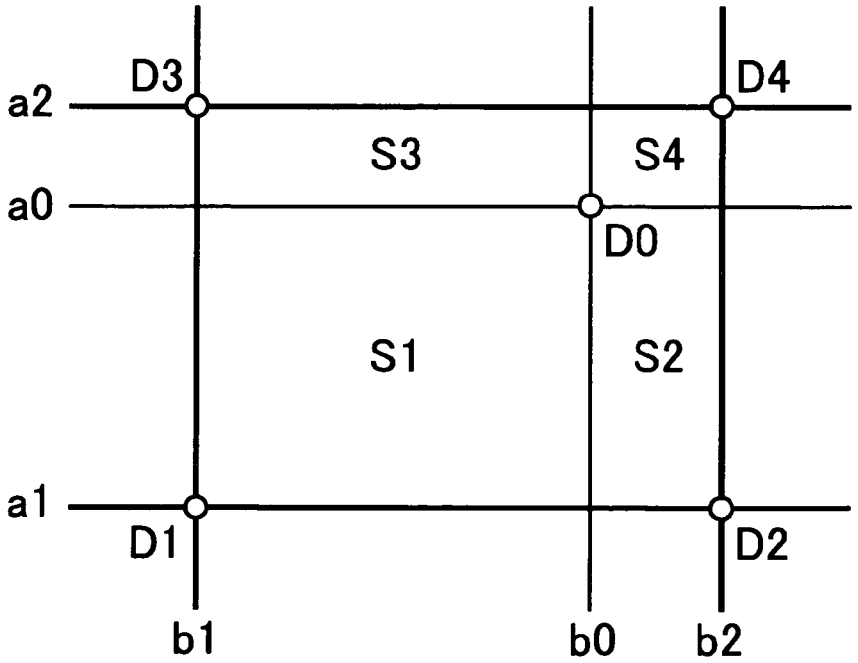
FIG. 3 is a drawing for explaining an exemplary procedure of interpolation.

FIG. 3 explains an exemplary procedure of the interpolation. The signal levels of the input data are a0 and b0. Firstly, the interpolation circuit 20 receives the representative correction values stored in the cells of the LUT 16 surrounding the address corresponding to the combination of the levels of the input data a0 and b0. As shown in FIG. 3, the signal level a0 is between the representative levels a1 and a2 of one of the input data. The signal level b0 is between the representative levels of b1 and b2 of the other one of the input data. Accordingly, the interpolation circuit 20 receives the representative correction values D1, D2, D3, and D4 corresponding to the combinations of the representative levels (a1, b1), (a1, b2), (a2, b1), and (a2, b2), respectively.

After having received the representative correction values, the interpolation circuit 20 generates the correction value corresponding to the combination of the input signal levels a0 and b0 by an interpolation from the representative correction values received from the LUT 16. As shown in FIG. 3, a rectangle surrounded by these representative levels are divided into four rectangles by the horizontal and vertical lines corresponding to the signal levels a0 and b0. The areas of the rectangles including the points (a1, b1), (a1, b2), (a2, b1), and (a2, b2) as corners are S1, S2, S3, and S4, respectively. The correction value D0 corresponding to the combination (a0, b0) may be calculated by using the following equation (1).

$$D0=(D4\cdot S1+D3\cdot S2+D2\cdot S3+D1\cdot S4)/(S1+S2+S3+S4) \quad (1)$$

When, on the other hand, the detection signal indicates that the address does not correspond to any of the combinations of the representative levels and that the address is on or near the diagonal line, the interpolation circuit 20 generates the correction value using the following procedure: Firstly, the interpolation circuit 20 substitutes one of the representative correction values stored in one of the pairs of adjacent cells with a substituted representative correction values. The substituted representative correction value indicates an opposite direction and the same amount of correction indicated by the other one of the representative correction values stored in the adjacent cells. Then, the correction value for correcting the level of pixel-driving signal to be supplied to the liquid crystal panel is generated by an interpolation using, for example, equation (1).

Accordingly, the interpolation circuit 20 may generate adequate correction values when the address is on or near the diagonal line.

For example, when the LUT 16 stores representative correction values that are to be added to the current-frame signal levels, the substituted representative correction value may be a value having an opposite sign and the same absolute value as those of the other one of the representative correction values stored in the adjacent cells.

According to various other exemplary conversion circuits, the input data (the current-frame input data) and the data output from the memory 12 (the previous-frame input data) may be supplied directly to the LUT 16. That is, the address conversion circuit 14 may be omitted so that the LUT 16 directly receives the set of input data. Similarly, the address detection circuit 18 may directly receive the set of input data and perform the detection by using the signal levels of the set of input data, instead of using the address generated by the address conversion circuit 14.

Next, the exemplary data conversion circuit is further explained in detail with reference to FIG. 4.

Figure 4:
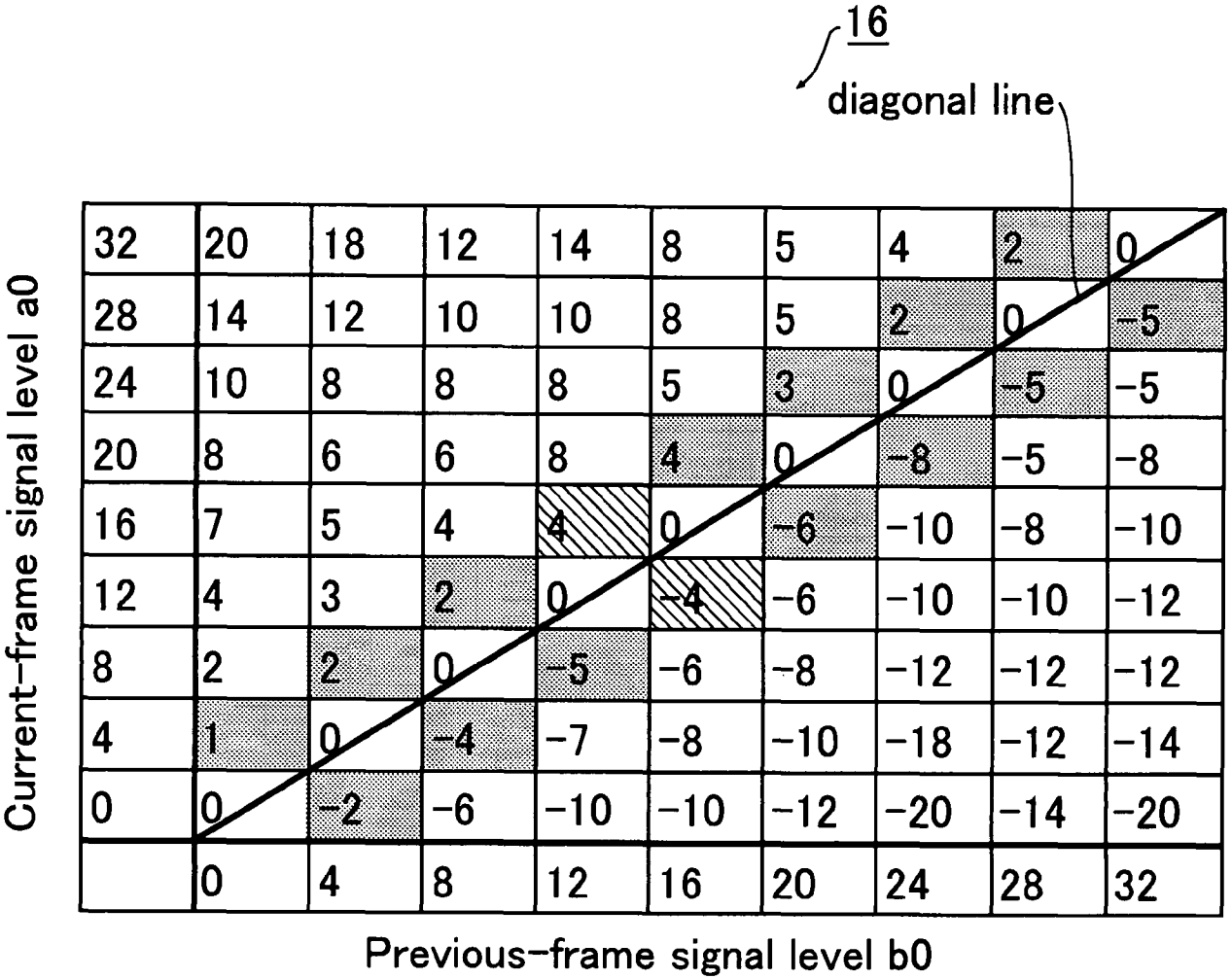
FIG. 4 shows an exemplary LUT to be used in exemplary data conversion circuits according to this invention.

FIG. 4 shows an exemplary LUT 16 that stores the output data (the representative correction values) corresponding to combinations of representative levels of the current-frame pixel signal a0 and the representative levels of the previous-frame pixel signal b0.

The left-most column of the exemplary LUT 16 shows representative levels of one of the set of input data, or the current-frame pixel signal a0. The lower-most row of the LUT shows representative levels of the other one of the set of input data, or the previous-frame pixel signal b0. It is assumed that, for simplicity, these input data may have levels of 0 to 32. Every one of four levels, i.e., levels 0, 4, 8, . . . 32 are adapted as the representative levels.

The remaining portion of the LUT 16, i.e., the 2nd to 10th columns from the left and the 1st to 9th rows from the top, shows the output data corresponding to the combinations of the representative levels of the set of input data.

The output data shown in the LUT 16 includes the representative correction values to be applied to the input data. Specifically, the values are to be added to the levels of the current-frame pixel signal to generate the corrected signal.

In the cells arranged on the diagonal line of the LUT 16, where the previous-frame signal level and the current-frame signal level are the same, the value of zero, which means that no correction is made, are stored. Positive values are stored in the cells arranged in the area on the upper side of the diagonal line, and negative values are stored in the cells arranged in the area on the lower side of the diagonal line. The positive value indicates correction in the positive direction, or that the level of the current-frame signal should be increased to generate the corrected signal. The negative value indicates correction in the negative direction, or that the level of the current-frame signal should be decreased to generate the corrected signal.

In the exemplary LUT 16, one of the pairs of cells arranged symmetrically along both sides of the diagonal line, which are marked with hatchings (the cell in the fifth column from the left and the fifth row from the top, and the cell in the sixth column from the left and the sixth row from the top) store values of 4 and −4, respectively. This pair of values has different signs and the same absolute value, which indicates mutually opposite directions and the same amount of corrections.

Each of the other pairs of cells positioned symmetrically along both sides of the diagonal line (adjacent cells) and that are shaded, store values having mutually opposite signs and different absolute values. Each of these pairs of correction values indicates mutually opposite directions and different amounts of corrections.

Exemplary procedures for generating conversion data performed by the exemplary data conversion circuit 10 will be explained below.

Firstly, an exemplary case with the level of the current-frame pixel signal a0=19 and the level of the previous-frame signal b0=9 will be considered. These signal levels are not the representative levels. Furthermore, the address corresponding to the combination of the input levels is not on or near the diagonal line. Therefore, the interpolation circuit 20 receives the representative correction values stored in the cells of the LUT 16 surrounding the address. Then the interpolation circuit generates the correction value by the procedure explained in FIG. 5.

Figure 5:
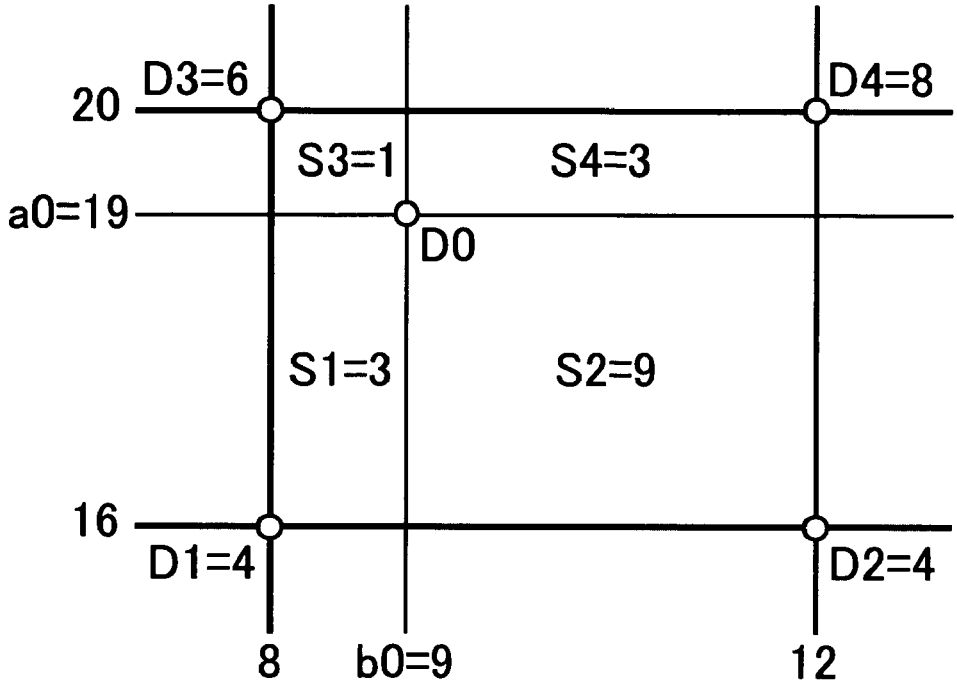
FIG. 5 is a drawing for explaining an exemplary procedure of interpolation performed using the LUT shown in FIG. 4.

As shown in FIGS. 4 and 5, the representative correction values stored in the surrounding cells are D1=4, D2=4, D3=6, D4=8, respectively. Then, the interpolation circuit 20 generates the correction value D0 using the following equation (2).

$$D0 = \frac{(D4 \cdot S1 + D3 \cdot S2 + D2 \cdot S3 + D1 \cdot S4)}{(S1 + S2 + S3 + S4)} = (8 \times 3 + 6 \times 9 + 4 \times 1 + 4 \times 3)/(3 + 9 + 1 + 3) = 5.9 \quad (2)$$

Next, another exemplary case with the level of the current-frame pixel signal a0=10 and the level of the previous-frame signal b0=10 will be considered. The address corresponding to the combination of the input signal levels is on the diagonal line of the LUT. However, these signal levels are not the representative levels. Therefore, the interpolation circuit 20 generates the correction value via interpolation from the representative correction values stored in the cells surrounding the address corresponding to the combination of the signal levels.

Figure 6:
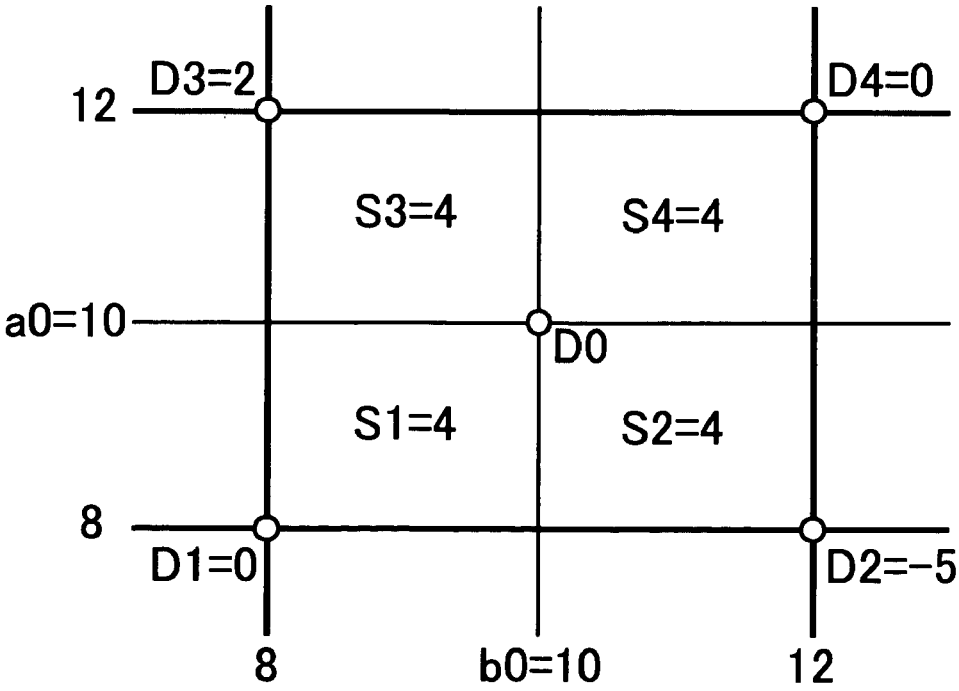
FIG. 6 is a drawing for explaining a conventional procedure of interpolation using the LUT shown in FIG. 4.

A conventional interpolation procedure will be explained with reference to FIG. 6. As shown in FIGS. 4 and 6, the representative correction values stored in the surrounding cells are D1=0, D2=−5, D3=2, D4=0, respectively. A conventional interpolation circuit generates the correction value D0 using the following equation (3).

$$D0 = \frac{(D4 \cdot S1 + D3 \cdot S2 + D2 \cdot S3 + D1 \cdot S4)}{(S1 + S2 + S3 + S4)} = (0 \times 4 + 2 \times 4 + (-5) \times 4 + 0 \times 4)/(4 + 4 + 4 + 4) = -0.8 \quad (3)$$

In this example, the signal levels of the set of input data are the same with each other (a0=b0=10). Therefore, no correction to improve the response of the LCD panel is needed, or the correction value should be zero. As shown in the equation (3), however, the conventional conversion circuit generates a correction value that is different from zero. This is because the representative correction values used for the interpolation includes values having opposite signs and different absolute values (D2=−5 and D3=2), which are stored in one of the pairs of cells arranged symmetrically along both sides of the diagonal line.

In other words, because the pair of representative correction values used for the interpolation is not symmetrical, although these values are stored in a pair of cells arranged symmetrically along both sides of the diagonal line. As a result, the correction value calculated by the linear interpolation is not equal to zero.

Figure 7:
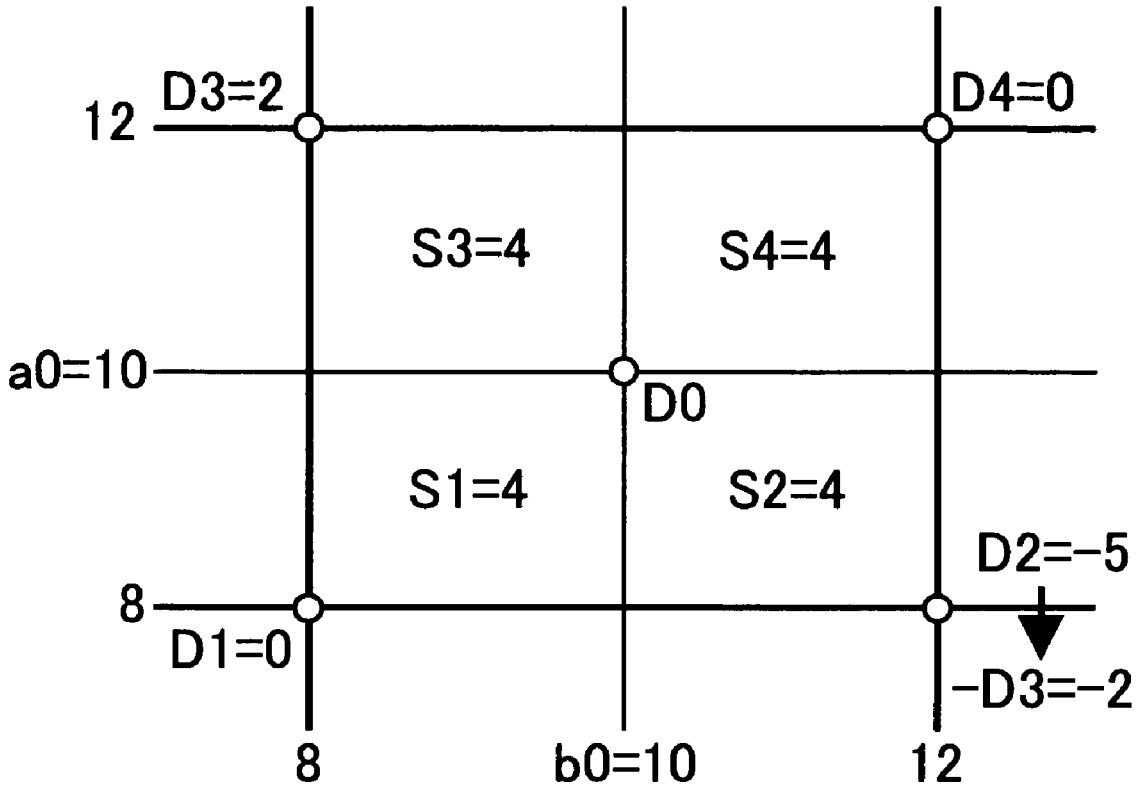
FIG. 7 is a drawing for explaining an exemplary procedure of interpolation performed using the LUT shown in FIG. 4 according to this invention.

On the other hand, in an exemplary conversion circuit 10 according to this invention, the correction value D0 is generated by the procedure shown in FIG. 7.

That is, the address detection circuit 18 detects that the address corresponding to the combination of the signal levels of the input data a0=10 and b0=10 is on the diagonal line of the LUT 16. Then the interpolation circuit 20 substitutes one of the representative correction values stored in one of the pairs of cells arranged symmetrically along both sides of the diagonal line (adjacent cells) with a substituted representative correction value. The substituted representative correction value indicates the opposite direction and the same amount of correction as indicated by the other one of the representative correction values stored in the pair of adjacent cells.

In the example shown in FIG. 7, the representative correction values stored in the pair of adjacent cells are D2=−5 and D3=2. The value of −5 is substituted with the value of −2, which has the opposite sign and the same absolute value as those of the other one of the representative correction values stored in the adjacent cells. Then, the interpolation circuit 20 generates the correction value D0 using the following equation (4).

$$D0 = \frac{(D4 \cdot S1 + D3 \cdot S2 + (-D3) \cdot S3 + D1 \cdot S4)}{(S1 + S2 + S3 + S4)} = (0 \times 4 + 2 \times 4 + (-2) \times 4 + 0 \times 4)/(4 + 4 + 4 + 4) = 0 \quad (4)$$

According to an exemplary procedure shown in FIG. 7, the address corresponding to the combination of input signal levels is on the diagonal line of the LUT 16. The interpolation circuit 20 substitutes one of the representative correction values stored in the pair of cells positioned along both sides of the diagonal line (adjacent cells) with the substituted representative correction value having the opposite sign and the same absolute value as those of the other one of the representative correction values stored in the adjacent cells. As a result, the interpolation circuit 20 generates an adequate correction value of D0=0 via interpolation using the substituted representative correction value and three other representative correction values.

Accordingly, the continuity of the corrected data, or the continuity of the levels of the corrected signal, can be maintained, and the display quality can be improved.

The same procedure may be applied when the address corresponding to the combination of the input signal levels is not on the diagonal line but near the diagonal line. That is, according to the conventional conversion circuit, the same problem of loss of continuity of the correct data may occur when the address is within a range from the diagonal line that the cells surrounding the address includes one of the pairs of cells positioned symmetrically along both sides of the diagonal line (adjacent cells).

Also in this case, one of the representative correction values stored in the adjacent cells is substituted with a substituted representative correction value having the opposite sign and the same absolute value as those of the other one of the representative correction values stored in the adjacent cells. Then, using the same equation (4), the interpolation circuit 20 properly calculates the correction value D0. Accordingly, the continuity of the output data, or the continuity of the levels of the corrected signal, can be maintained, and the display quality can be improved.

As such, according to various exemplary embodiments of this invention, when the difference between the levels of the set of input data is small, one of the representative correction values stored in one of the pair of cells arranged symmetrically along both sides of the diagonal line of the LUT is substituted. The substituted representative correction value indicates an opposite direction and the same amount of correction indicated by the other one of the representative correction values stored in the pair of cells. The correction value is then generated by an interpolation using the substituted representative correction value. Therefore, an adequate correction value can be generated when the difference between the signal levels is small. Accordingly, the continuity of the corrected data may be maintained and the display quality may be improved.

Even when the cells surrounding the address corresponding to the combination of the input signal levels include one of the pairs of adjacent cells, it is not always necessary to substitute one of the representative correction values stored in the adjacent cells. That is, the substitution is required only when the representative correction values stored in the pair of adjacent cells surrounding the address indicate different amounts of corrections.

Accordingly, it is possible to provide a detection circuit so that the interpolation circuit 20 performs the substitution only when the detection circuit detects that the representative correction values stored in the pair of adjacent cells surrounding the address indicate different amount of corrections. It is also possible to substitute one of the representative correction values when the cells surrounding the address include any one of the pairs of adjacent cells without examining the amounts of corrections indicated by the representative correction values stored in the pair of adjacent cells. The latter is advantageous to shorten the processing time.

In an exemplary interpolation procedure shown in FIG. 7, the representative correction value D2 is substituted with the substituted representative correction value −D3. It is also possible to substitute the representative correction value D3 with the substituted representative correction value −D2.

In the exemplary LUT 16 shown in FIG. 4, every one of four levels of input data are adapted as the representative input levels. However, the representative levels may be selected differently.

The exemplary LUT 16 may be constructed using a memory block such as a SRAM block. Although FIG. 4 shows the left-most column and the lower-most row in which the representative levels of the set of input data are shown, only the output data, or the representative correction values are stored in the SRAM. The combinations of the representative levels of the set of input data are used to access the SRAM.

As explained above, the exemplary address conversion circuit 14 may generate the 16-bit address by joining the two 8-bit data representing the current-frame and the previous frame signal levels, and supply the generated address to the LUT 16. Because the LUT 16 only stores representative correction values corresponding to combinations of representative signal levels, however, not all of the bits representing the signal levels are required to access the SRAM.

For example, when levels 0, 4, 8, 12 . . . are used as the representative levels, the lower two bits of data representing each of the signal levels are not required to access the SRAM. Nonetheless, the LUT 16 may use the lower bits to determine if the address corresponds to one of the combinations of the representative levels. The exemplary address detection circuit 18 and the interpolation circuit 20 also require the lower bits. For example, the address detection circuit 18 may use the lower bits for detecting whether the address corresponds to one of the combinations of representative levels, or whether the address locates on or near the diagonal line.

In the exemplary LUT 16 shown in FIG. 4, representative correction values to be added to the level of the current-frame input signal are stored. In this case, although not shown in FIG. 1, the correction value generated by the interpolation circuit 20 may be added to the level of the current-frame signal to generate a corrected pixel-driving signal. The corrected pixel-driving signal may be converted to an analog pixel-driving signal and supplied to a driver of the liquid crystal display panel.

It is also possible to provide a LUT that stores, as the representative correction values, levels of the corrected, or the converted signal.

FIG. 8 shows an exemplary LUT 26 that stores, as the representative correction values, levels of the corrected signal corresponding to combinations of representative levels of the current-frame input signal a0 and the representative levels of the previous-frame input signal b0. The representative correction value stored in each of the cells of the LUT 26 is equal to the sum of the level of current-frame input signal a0 and the representative correction value stored in the corresponding cell of the LUT 16 shown in FIG. 4.

In the cells arranged on the diagonal line of the LUT 26, values equal to the corresponding representative levels of the current-frame signal a0 are stored, which means that no correction is made. In the cells arranged in the area on the upper side of the diagonal line, values larger than the corresponding representative levels of the current-frame signal a0 are stored, which means that corrections toward the positive direction are made. In the cells arranged in the area on the lower side of the diagonal line, values smaller than the corresponding representative levels of the current-frame signal a0 are stored, which means that corrections toward the negative direction are made.

In the exemplary LUT 26, one of the pairs of cells arranged symmetrically along both sides of the diagonal line, which are marked with hatchings, stores values 20 and 8, respectively. The value 20 stored in the cell in the fifth column from the left and the fifth row from the top is larger than the corresponding current-frame input signal level (a0=16) by 4. The value 8 stored in the sixth column from the left and the sixth row from the top is smaller than the corresponding current-frame input signal level (a0=12) by 4. This pair of representative correction values indicates mutually opposite directions and the same amount of corrections.

Each of the other pairs of cells arranged symmetrically along both sides of the diagonal line, which are shaded, stores values that indicate mutually opposite directions and different amounts of corrections. For example, the value 14 stored in the cell in the fourth column from the left and the sixth row from the top is larger than the corresponding current-frame input signal level (a0=12) by 2. This value indicates a correction toward the positive direction with an amount of 2. On the other hand, the value 3 stored in the cell in the fifth column from the left and the seventh row from the top is smaller than the corresponding current-frame input signal level (a0=8) by 5. This value indicates a correction toward the negative direction with an amount of 5.

The interpolation circuit 20 may perform the interpolation similarly when the LUT 16 is replaced with the LUT 26. Especially, when the cells surrounding the address corresponding to the combination of the input signal levels include one of the pairs of cells arranged along both sides of the diagonal line (adjacent cells), one of the representative correction values stored in the pair of adjacent cells is substituted and then interpolated using a substituted representative correction value.

Figure 9:
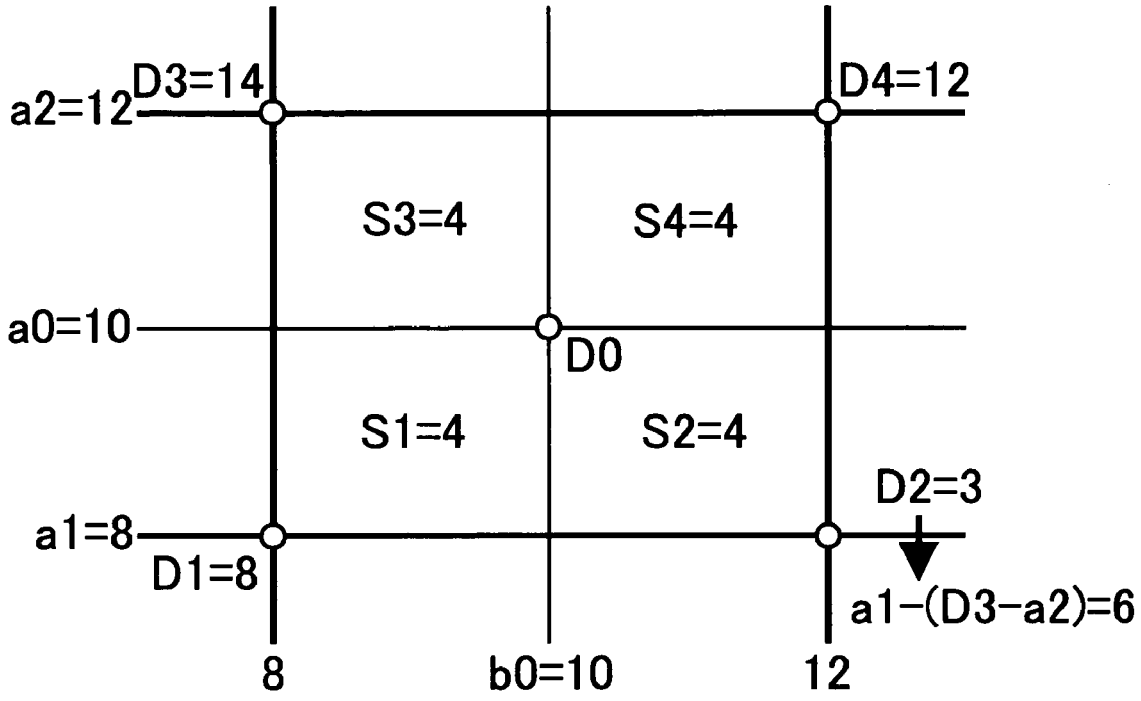
FIG. 9 is a drawing for explaining an exemplary procedure of interpolation performed using the LUT shown in FIG. 8 according to this invention.

An exemplary procedure of interpolation using the LUT 26 shown in FIG. 8 will be explained with reference to FIG. 9. For example, when the levels of the input data are a0=10 and b0=10, the surrounding cells include one of the pairs of adjacent cells, i.e., the cell in the fourth column from the left and the sixth row from the top and the cell in the fifth column from the left and the seventh row from the top. In this case, the interpolation circuit 20 may substitute one of the representative correction values stored in the pair of adjacent cells (14 and 3) with a substituted representative correction value.

For example the representative correction value of 3 may be substituted with the value of 6, which indicates a correction toward the opposite direction with the same amount (2) indicated by the other one of the representative correction values. That is, the difference between the substituted representative correction value (6) and the corresponding representative levels of the current-frame input data (a1=8) is −2, which indicates a correction toward the negative direction with an amount of 2. While the difference between the other one of the representative correction values stored in the adjacent cells (14) and the corresponding representative levels of the current-frame input data (a2=12) is 2, which indicates a correction toward the positive direction with an amount of 2. These two differences have mutually opposite signs and the same absolute value.

Then the interpolation circuit 20 generates the correction value D0 using the following equation (5).

$$\begin{aligned} D0 &= \frac{(D4\cdot S1 + D3\cdot S2 + (a1 - (D3 - a2))\cdot S3 + D1\cdot S4)}{(S1 + S2 + S3 + S4)} \\ &= (12\times 4 + 14\times 4 + (8-2)\times 4 + 8\times 4)/(4+4+4+4) \\ &= 10 \end{aligned} \tag{5}$$

Thus, the interpolation circuit 20 generates an adequate correction value of 10, which is equal to the level of the current-frame input signal.

As can be seen in FIG. 8, the representative correction values stored in the exemplary LUT 26 include some negative values. When the driver of the liquid crystal display panel cannot accept negative pixel-driving signal, the corrected signal may be supplied to the driver through a limiter.

Alternatively, as described in, for example, FIG. 10 of U.S. Pat. No. 6,853,384, which is hereby incorporated by reference in its entirety, the correction values stored in the LUT 26 may be shifted with a fixed amount so that any of the correction values do not take a negative value. In this case, the representative correction values stored in the cells arranged on the diagonal line is larger than the levels of the corresponding current-frame signal by the shift amount. Still, the correction values stored in the cells on the diagonal line indicate that no conversion or correction for improving the response of the liquid crystal panel is made. In other words, the representative correction values stored in the LUT excluding the fixed shift indicate the directions and the amounts of corrections.

In the exemplary embodiments described above, the two-dimensional LUT 16 or 26 is employed and the correction value is calculated by a linear interpolation using the equations (1), (2), (4) and (5). However, various other interpolation equations may be used. In the exemplary embodiments described above, the interpolation circuit generates the correction values from four representative correction values corresponding to combinations of two representative levels adjacent to the input signal level for each of the input data. However, the interpolation circuit may perform interpolation using representative values corresponding to combinations of more than two representative values for each of the input data.

It is also possible to employ three-dimensional LUTs that store representative correction values corresponding to combinations of representative input levels of three input data. For example, a three-dimensional LUT may store representative correction values corresponding to representative signal levels of three consecutive frames, or may store representative correction values corresponding to representative levels of three primary color signals.

When using a three-dimensional LUT, the interpolation may be performed based on the representative correction values and the volumes of rectangular parallelepipeds divided by surfaces corresponding to the input signal levels.

In the exemplary embodiments described above, the data conversion circuit and the method of data conversion are applied for correcting the pixel-driving signal in a liquid crystal display apparatus. According to various other exemplary embodiments of data conversion circuits and methods of data conversion, however, this invention may be applied to various data conversions in various other apparatuses.

Thus far, exemplary data conversion circuits and methods of data conversion are explained in detail in reference to preferred embodiments. However, this invention is not limited to the specific embodiments described above. It is possible to make various improvements and modifications in the sprit of this invention.

What is claimed is:

1. A data conversion circuit for generating conversion data from a set of input data, each of the set of input data comprising a signal level selected from a plurality of allowable levels including representative levels, the conversion circuit comprising:

a look-up table (LUT) that stores output data including representative correction values corresponding to combinations of the representative levels of the set of input data in at least one of two- and three-dimensionally arranged cells, the cells including diagonal cells arranged on a diagonal line of the LUT and a plurality of pairs of adjacent cells, each of the pairs of adjacent cells being arranged symmetrically along both sides of the diagonal line; and an interpolation circuit that generates the conversion data by interpolating from the representative correction values stored in the cells of the LUT that surround an address corresponding to a combination of the signal levels of the set of input data, wherein:

the representative correction values stored in the diagonal cells indicate that no conversion is made;

the representative correction values stored in at least one of the pairs of adjacent cells have mutually opposite signs and different absolute values; and the interpolation circuit substitutes, when the cells that surround the address includes the at least one of the pairs of adjacent cells, one of the representative correction values stored in the adjacent cells with a substituted representative correction value having a sign opposite to and an absolute value same as those of the other one of the representative correction values stored in the adjacent cells, and then generates the conversion data using the substituted representative correction value.

2. The data conversion circuit according to claim 1, further comprising:

an address detection circuit that detects whether the address is within a range from the diagonal line of the LUT such that the cells that surround the address include one of the pairs of adjacent cells, wherein the interpolation circuit substitutes the one of the representative correction values when the address detection circuit detects that the address is within the range.

3. The data conversion circuit according to claim 1, further comprising:

an address conversion circuit that generates the address from the signal levels of the set of input data.

4. The data conversion circuit according to claim 1, wherein:

the LUT is a two-dimensional LUT; and the interpolation circuit generates the conversion data by a linear interpolation from four of the representative correction values corresponding to combinations of two of the representative levels adjacent to the signal level of each of the set of input data.

5. A data conversion circuit for generating conversion data from a set of input data, each of the set of input data comprising a signal level selected from a plurality of allowable levels including representative levels, the conversion circuit comprising:

a look-up table (LUT) that stores output data including representative correction values that indicate directions and amounts of corrections and that correspond to combinations of the representative levels of the set of input data in at least one of two- and three-dimensionally arranged cells, the cells including diagonal cells arranged on a diagonal line of the LUT and a plurality of pairs of adjacent cells, each of the pairs of the adjacent cells being arranged symmetrically along both sides of the diagonal line; and an interpolation circuit that generates the conversion data by interpolating from the representative correction values stored in the cells of the LUT that surround an address corresponding to a combination of the signal levels of the set of input data;

wherein:

the representative correction values stored in the diagonal cells indicate that no correction is made;

the representative correction values stored in at least one of the pairs of adjacent cells indicate mutually opposite directions and different amounts of the corrections; and the interpolation circuit substitutes, when the cells that surround the address include the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and then generates the conversion data using the substituted representative correction value.

6. The data conversion circuit according to claim 5, wherein:

the representative correction values stored in the diagonal cells are zero; and the substituted representative correction value and the other one of the representative correction values stored in the adjacent cells have mutually opposite signs and a same absolute value.

7. The data conversion circuit according to claim 5, wherein:

the representative correction values stored in the diagonal cells are equal to respective corresponding ones of the representative levels of one of the set of input data; and a first difference between the substituted representative correction value and a first corresponding one of the representative levels of the one of the set of input data and a second difference between the other one of the representative correction values stored in the adjacent cells and a second corresponding one of the representative levels of the one of the set of input data have mutually opposite signs and a same absolute value.

8. The data conversion circuit according to claim 5, further comprising:

an address detection circuit that detects whether the address is within a range from the diagonal line of the LUT such that the cells that surround the address include one of the pairs of adjacent cells, wherein the interpolation circuit substitutes the one of the representative correction values when the address detection circuit detects that the address is within the range.

9. A data conversion circuit, comprising:

an input terminal for receiving current input data, the input data having a signal level selected from a plurality of allowable levels including representative levels;

a memory for storing the current input data and for outputting a previous input data;

a look-up table (LUT) that stores representative correction values that indicate directions and amounts of corrections and that correspond to combinations of the representative levels of the current and previous input data in two-dimensionally arranged cells, the cells including diagonal cells arranged on a diagonal line of the LUT and a plurality of pairs of adjacent cells, each of the pairs of the adjacent cells being arranged symmetrically along both sides of the diagonal line; and an interpolation circuit that generates a correction value corresponding to a combination of the signal levels of the current and the previous input data by interpolating from the representative correction values stored in the cells of the LUT that surround an address corresponding to the combination of the signal levels;

wherein:

the representative correction values stored in the diagonal cells indicate that no correction is made;

the representative correction values stored in at least one of the pairs of adjacent cells indicate mutually opposite directions and different amounts of corrections; and the interpolation circuit substitutes, when the cells that surround the address include the at least one of the pairs of adjacent cells, one of the representative correction values stored in the adjacent cells with a substituted representative correction value that indicates an opposite direction and a same amount of correction as indicated by the other one of the representative correction values stored in the adjacent cells, and then generates the correction value using the substituted representative correction value.

10. The data conversion circuit according to claim 9, wherein:

the representative correction values stored in the diagonal cells are zero; and the substituted representative correction value and the other one of the representative correction values stored in the adjacent cells have mutually opposite signs and a same absolute value.

11. The data conversion circuit according to claim 9, wherein:

the representative correction values stored in the diagonal cells are equal to respective corresponding ones of the representative levels of the current input data; and a first difference between the substituted representative correction value and a first corresponding one of the representative levels of the current input data and a second difference between the other one of the representative correction values stored in the adjacent cells and a second corresponding one of the representative levels of the current input data have mutually opposite signs and a same absolute value.

12. The data conversion circuit according to claim 9, further comprising:

an address detection circuit that detects whether the address is within a range from the diagonal line of the LUT such that the cells that surround the address includes one of the pairs of adjacent cells, wherein the interpolation circuit substitutes the one of the representative correction values when the address detection circuit detects that the address is within the range.

13. A method of data conversion, comprising:

receiving a set of input data via a data input connection, each of the set of input data comprising a signal level selected from a plurality of allowable levels including representative levels;

providing, in a look-up table (LUT), stored in a storage device, output data including representative correction values corresponding to combinations of the representative levels of the set of input data in at least one of two- and three-dimensionally arranged cells, the cells including diagonal cells arranged on a diagonal line of the LUT and a plurality of pairs of adjacent cells, each of the pairs of adjacent cells being arranged symmetrically along both sides of the diagonal line; and generating a conversion data by referencing the stored LUT and interpolating from the representative correction values stored in the cells of the LUT that surround an address corresponding to a combination of the input levels of the set of input data;

wherein:

the representative correction values stored in the diagonal cells indicate that no conversion is made;

the representative correction values stored in at least one of the pairs of adjacent cells have mutually opposite signs and different absolute values; and generating the conversion data includes substituting, when the cells that surround the address include the at least one of the pairs of adjacent cells, one of the representative correction values stored in the adjacent cells with a substituted representative correction value having a sign opposite to and an absolute value same as those of the other one of the representative correction values stored in the adjacent cells, and the interpolation is performed using the substituted representative correction value.

14. The method of data conversion according to claim 13, wherein:

the LUT is a two-dimensional LUT; and generating the conversion data comprises performing a linear interpolation from four of the representative correction values corresponding to combinations of two of the representative levels adjacent to the signal level of each of the input data.

15. A method of data conversion, comprising:

receiving a set of input data via a data input connection, each of the set of input data comprising a signal level selected from a plurality of allowable levels including representative levels;

providing, in a look-up table (LUT), stored in a storage device, output data including representative correction values that indicate directions and amounts of corrections and that correspond to combinations of the representative levels of the set of input data in at least one of two- and three-dimensionally arranged cells, the cells including diagonal cells arranged on a diagonal line of the LUT and a plurality of pairs of adjacent cells, each of the pairs of adjacent cells being arranged symmetrically along both sides of the diagonal line; and generating a conversion data by referencing the stored LUT and interpolating from the representative correction values stored in the cells of the LUT that surround an address corresponding to a combination of the signal levels of the set of input data;

wherein:

the representative correction values stored in the diagonal cells indicate that no conversion is made;

the representative correction values stored in at least one of the pairs of adjacent cells indicate mutually opposite directions and different amounts of the corrections; and generating the conversion data includes substituting, when the cells that surround the address include the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and the interpolation is performed using the substituted representative correction value.

16. The method according to claim 15, wherein:

the representative correction values stored in the diagonal cells are zero; and the substituted representative correction value and the other one of the representative correction values stored in the adjacent cells have mutually opposite signs and a same absolute value.

17. The method according to claim 15, wherein:

the representative correction values stored in the diagonal cells are equal to respective corresponding ones of the representative levels of one of the set of input data; and a first difference between the substituted representative correction value and a first corresponding one of the representative levels of the one of the set of input data and a second difference between the other one of the representative correction values stored in the adjacent cells and a second corresponding one of the representative levels of the one of the set of input data have mutually opposite signs and a same absolute value.

18. A method of data conversion, comprising:

receiving a current input data having a signal level selected from a plurality of allowable levels including representative levels;

storing the current input data into a memory and outputting a previous input data from the memory;

providing a look-up table (LUT) that stores representative correction values that indicate directions and amounts of corrections and that correspond to combinations of the representative levels of the current and previous input data in two-dimensionally arranged cells, the cells including diagonal cells arranged on a diagonal line of the LUT and a plurality of pairs of adjacent cells, each of the pairs of adjacent cells being arranged symmetrically along both sides of the diagonal line; and generating a correction value corresponding to a combination of the signal levels of the current and previous input data by interpolating from the representative correction values stored in the cells of the LUT that surround an address corresponding to the combination of the signal levels of the current and the previous of input data;

wherein:

the representative correction values stored in the diagonal cells indicate that no conversion is made;

the representative correction values stored in at least one of the pairs of adjacent cells indicate mutually opposite directions and different amounts of the corrections; and generating the correction value includes substituting, when the cells that surround the address include the at least one of the pairs of adjacent cells, one of the representative correction values stored in the adjacent cells with a substituted representative correction value that indicates an opposite direction and a same amount of the correction as indicated by the other one of the representative correction values stored in the adjacent cells, and the interpolation is performed using the substituted representative correction value.

19. The method according to claim 18, wherein:

the representative correction values stored in the diagonal cells are zero; and the substituted representative correction value and the other one of the representative correction values stored in the adjacent cells have mutually opposite signs and a same absolute value.

20. The method according to claim 18, wherein:

the representative correction values stored in the diagonal cells are equal to corresponding ones of the representative levels of the current input data; and a first difference between the substituted representative correction value and a first corresponding one of the representative levels of the current input data and a second difference between the other one of the representative correction values stored in the adjacent cells and a second corresponding one of the representative levels of the current input data have mutually opposite signs and a same absolute value.

* * * * *